US008046957B2

(12) United States Patent
Towersey et al.

(10) Patent No.: US 8,046,957 B2
(45) Date of Patent: Nov. 1, 2011

(54) STACK-ON PANEL ASSEMBLY

(75) Inventors: Charles D. Towersey, Rockford, MI (US); Gordon F. Chapman, Butler, IN (US); Randall Lee Bixler, LaGrange, IN (US)

(73) Assignee: Steelcase Inc., Grand Rapids, MI (US)

( * ) Notice: Subject to any disclaimer, the term of this patent is extended or adjusted under 35 U.S.C. 154(b) by 1322 days.

(21) Appl. No.: 11/603,538

(22) Filed: Nov. 22, 2006

(65) Prior Publication Data

US 2008/0115434 A1 May 22, 2008

(51) Int. Cl.

| | |
|---|---|
| ***A47F 10/00*** | (2006.01) |
| ***E04H 14/00*** | (2006.01) |
| ***E04B 1/61*** | (2006.01) |
| ***E04C 2/52*** | (2006.01) |
| ***E04B 2/00*** | (2006.01) |

(52) U.S. Cl. ..... 52/79.9; 52/239; 52/127.6; 52/220.7; 52/582.2

(58) Field of Classification Search ..... 52/79.1, 52/79.2, 79.9, 79.12, 79.13, 127.6, 127.7, 52/220.1, 220.2, 220.7, 582.2, 284, 285.1, 52/285.3, 36.1, 239

See application file for complete search history.

(56) References Cited

U.S. PATENT DOCUMENTS

| | | | | |
|---|---|---|---|---|
| 3,327,440 | A * | 6/1967 | Watkins | 52/239 |
| 4,448,003 | A | 5/1984 | Hasbrouck | |
| 4,535,577 | A * | 8/1985 | Tenser et al. | 174/495 |
| 4,644,993 | A | 2/1987 | Cooper et al. | |
| 4,712,336 | A * | 12/1987 | Backer | 52/71 |
| 4,942,709 | A | 7/1990 | Waldron | |
| 5,056,577 | A | 10/1991 | Delong et al. | |
| 5,058,347 | A | 10/1991 | Schuelke et al. | |
| 5,088,541 | A | 2/1992 | Persing et al. | |
| 5,092,385 | A * | 3/1992 | Beaulieu | 160/135 |
| 5,277,007 | A | 1/1994 | Hellwig et al. | |
| 5,394,668 | A | 3/1995 | Lim | |
| 5,431,210 | A | 7/1995 | Nelson et al. | |
| 5,433,046 | A | 7/1995 | MacQuarrie et al. | |
| 5,490,357 | A | 2/1996 | Lin | |
| 5,746,035 | A | 5/1998 | Seiber et al. | |
| 5,802,789 | A | 9/1998 | Goodman et al. | |
| 5,806,258 | A | 9/1998 | Miedema et al. | |
| 5,852,904 | A | 12/1998 | Yu et al. | |
| 5,979,118 | A | 11/1999 | Gortsema et al. | |
| 6,000,904 | A | 12/1999 | Musculus et al. | |
| 6,052,958 | A | 4/2000 | Miedema et al. | |
| 6,141,926 | A | 11/2000 | Rossiter et al. | |
| 6,167,676 | B1 | 1/2001 | Shipman et al. | |
| 6,250,029 | B1 | 6/2001 | Jeffers et al. | |

(Continued)

*Primary Examiner* — Basil Katcheves
*Assistant Examiner* — Ryan Kwiecinski
(74) *Attorney, Agent, or Firm* — Price Heneveld LLP

(57) ABSTRACT

A stack-on panel assembly for panel-based partition systems includes a connector bracket with a first portion shaped for connection with the top of an associated base panel, and a second portion upstanding from the first portion and having a first latch member. The stack-on panel assembly also includes a stacker panel having a bottom portion shaped for abutting support on top of the base panel, and a vertically extending slot disposed along one side to receive and retain therein the second portion of the connector bracket. A second latch member is disposed within the stacker panel at a location adjacent to the slot, and automatically engages and positively locks with the first latch member on the connector bracket when the stacker panel is lowered into place on top of the base panel to positively, yet detachably, connect the stacker panel on the base panel in a vertically stacked relationship.

58 Claims, 16 Drawing Sheets

U.S. PATENT DOCUMENTS 6,260,324 B1 7/2001 Miedema et al.
6,295,764 B1 10/2001 Berridge et al.
6,349,516 B1 2/2002 Powell et al.
6,389,773 B1 * 5/2002 Reuter et al. ..... 52/582.2
6,393,782 B1 * 5/2002 Berridge et al. ..... 52/239
6,393,783 B2 5/2002 Emaus et al.
6,394,689 B1 5/2002 Kuo
6,397,532 B1 6/2002 Shipman et al.
6,408,579 B1 6/2002 Anderson et al.
6,425,219 B1 * 7/2002 Barmak et al. ..... 52/239
6,430,880 B1 * 8/2002 Kemeny ..... 52/71
6,543,164 B1 * 4/2003 Sperl et al. ..... 40/605
6,658,805 B1 * 12/2003 Yu et al. ..... 52/239
6,684,929 B2 2/2004 MacDonald et al.
6,729,085 B2 5/2004 Newhouse et al.
6,754,998 B2 6/2004 Diffrient et al.
6,775,953 B2 * 8/2004 Burken et al. ..... 52/481.2
6,817,149 B2 11/2004 Diffrient et al.
6,820,388 B2 11/2004 Newhouse et al.
6,920,727 B2 7/2005 Yu et al.
6,928,785 B2 8/2005 Shipman et al.
6,964,138 B2 11/2005 Carroll et al.
2002/0069601 A1 6/2002 Hodges et al.
2003/0154672 A1 8/2003 Spransy et al.
2004/0093805 A1 5/2004 Underwood et al.
2004/0154756 A1 8/2004 MacDonald et al.
2006/0059806 A1 3/2006 Gosling et al.
2008/0115433 A1 * 5/2008 Towersey et al. ..... 52/284

* cited by examiner

STACK-ON PANEL ASSEMBLY

BACKGROUND OF THE INVENTION

The present invention relates to office partition panel systems, and in particular to a stack-on panel assembly that provides quick and easy on-site installation.

Versatile office floor plans have become increasingly important as building costs continue to grow. Modular furniture systems have been developed which are readily and easily erected and can be reconfigured in little time to accommodate the ever-changing needs of a large company or the divergent needs of several smaller companies occupying adjacent floor space. Movable or portable partition panels that are detachably interconnected and designed to partition office space into individual workstations and/or offices have proven useful. These partition panel arrangements are structurally sound and are capable of supporting worksurfaces including desks, shelves, and overhead cabinets. In addition, these partition panels have an acoustical sound-absorbing configuration that promotes a quiet and pleasant work environment.

In an effort to increase the versatility of the already adaptable partition panel systems, stacking panel arrangements have been developed that permit the height of a partition to be extended for a given application. Known stacking panel arrangements are often difficult to install, require multiple fasteners, and may have constructions that interfere with the routing of communication and/or power lines that travel through the partition system. Additionally, many known stacking panel arrangements have a multitude of parts, making construction tedious and time-consuming. Accordingly, a stack-on panel assembly that solves the above-identified problems is desirable and would be considered an improvement in the art.

SUMMARY OF THE INVENTION

One aspect of the present invention is a stack-on panel assembly for panel-based partition systems of the type including at least one base panel with a top portion. The stack-on panel assembly includes at least one connector bracket with a first portion thereof shaped for connection with the base panel and a second portion thereof upstanding from the first portion and having a first latch member thereon. The stack-on panel assembly also includes a stacker panel having a bottom portion thereof shaped for abutting support on the top portion of the base panel, and includes at least one vertically extending slot disposed along one side thereof to receive and retain therein the second portion of the connector bracket. A second latch member is included and is disposed within the stacker panel at a location adjacent to the slot. The second latch member automatically engages and positively locks with the first latch member on the connector bracket when the stacker panel is lowered into place on top of the base panel to positively, yet detachably, connect the stacker panel on the base panel in a vertically stacked relationship.

Another aspect of the present invention is a panel-based partition system including at least one base panel, and a stack-on panel assembly therefor. The stack-on panel assembly includes at least one connector bracket having a first portion thereof connected with the base panel and a second portion thereof upstanding from the first portion and having a first latch member thereon. A stacker panel has a bottom portion thereof abuttingly supported on the top portion of the base panel, and includes at least one vertically extending slot disposed along one side thereof to receive and retain therein the second portion of the connector bracket. A second latch member is disposed within the stacker panel at a location adjacent to the slot and automatically engages and positively locks with the first latch member on the connector bracket when the stacker panel is lowered into place on top of the base panel to positively, yet detachably, connect the stacker panel on the base panel in a vertically stacked relationship.

Yet another aspect of the present invention is a method for mounting a stacker panel on a base panel that includes fabricating at least one connector bracket having a first portion thereof shaped for connection with the base panel and a second portion thereof upstanding from the first portion and having a first latch member thereon. A stacker panel is fabricated with a bottom portion thereof shaped for abutting support on a top portion of the base panel. At least one vertically extending slot is formed along one side of the bottom portion of the stacker panel and is shaped to receive and retain therein the second portion of the connector bracket. A second latch member is mounted within the stacker panel at a location adjacent to the slot, and is configured to automatically engage and positively lock with the first latch member on the connector bracket when the stacker panel is lowered into place on top of the base panel. The first portion of the connector bracket is mounted to the base panel so that the second portion of the connector bracket is disposed adjacent one side of the base panel, and assumes a generally vertical orientation. The slot in the stacker panel is vertically aligned over the second portion of the connector bracket, and the stacker panel is lowered onto the upper portion of the base panel until the bottom portion of the stacker panel abuts the upper portion of the base panel, and the second latch member in the stacker panel engages and automatically locks with the first latch member on the connector bracket to positively, yet detachably, mount the stacker panel on the base panel in a vertically stacked relationship.

Yet another aspect of the present invention is a stack-on panel assembly that can be quickly and easily mounted on an associated base panel without separate fasteners. The stack-on panel assembly may be used in conjunction with solid stacker panels having a wide variety of exterior coverings, or a clear pane of glass or plastic. Further, the stack-on panel assembly is efficient in use, economical to manufacture, capable of a long operating life, and particularly adapted for the proposed use.

These and other features, advantages and objects of the present invention will be further understood and appreciated by those skilled in the art by reference to the following written specification, claims and appended drawings.

DETAILED DESCRIPTION OF THE PREFERRED EMBODIMENTS

Figure 1:
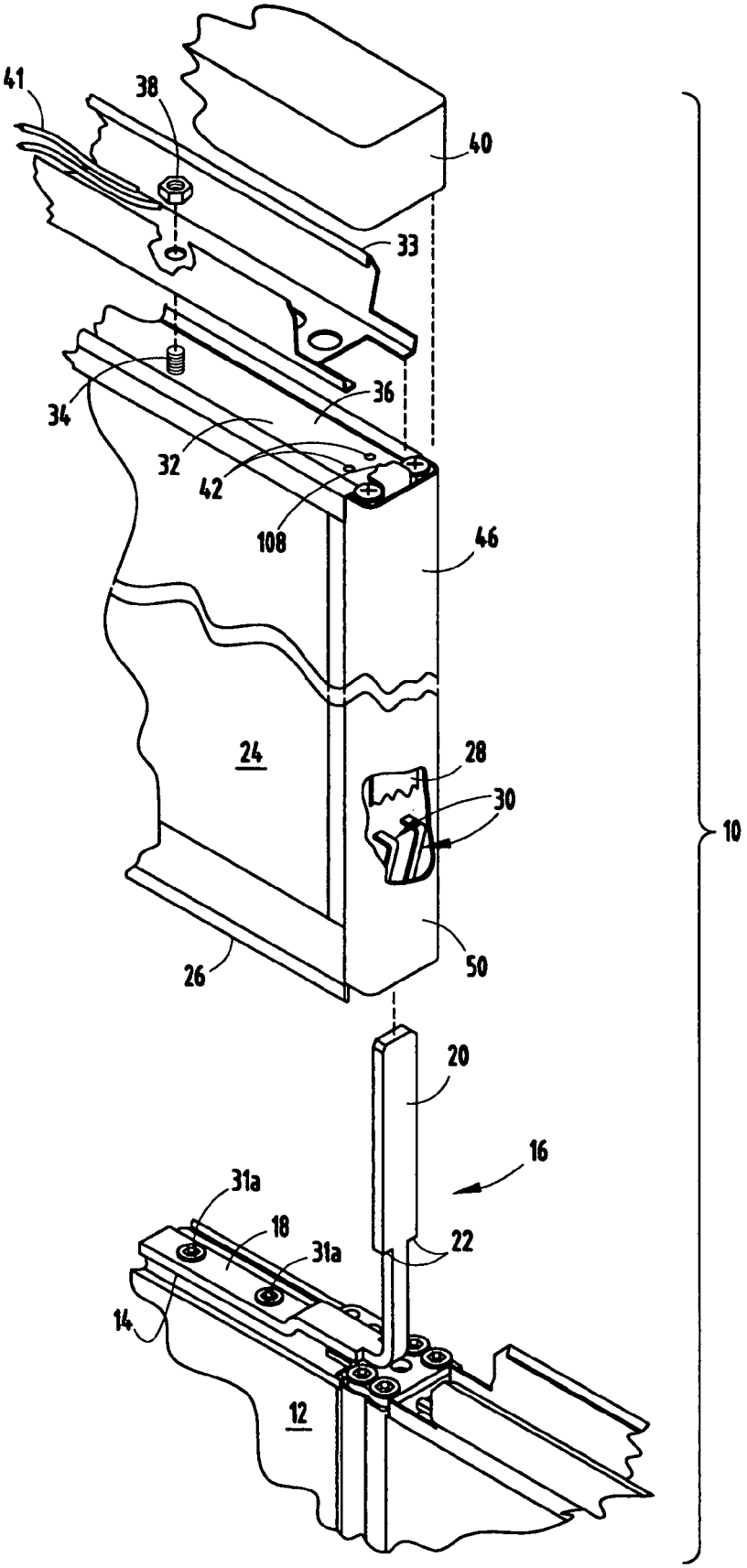
FIG. 1 is an enlarged exploded partial top perspective view of the stack-on panel assembly embodying the present invention.
Figure 2:
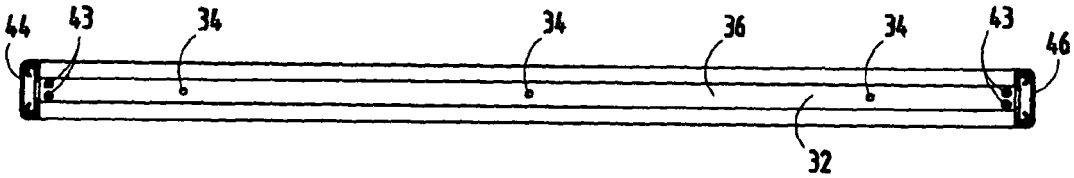
FIG. 2 is a top plan view of a stacker panel.
Figure 3:
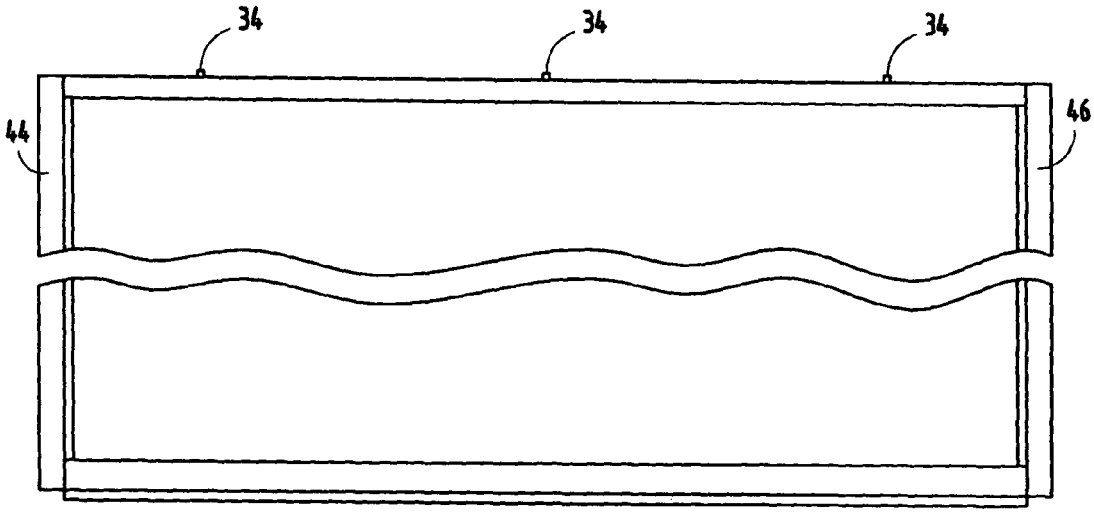
FIG. 3 is a front elevational view of a stacker panel.

For purposes of description herein the terms "upper", "lower", "right", "left", "rear", "front", "vertical", "horizontal" and derivatives thereof shall relate to the invention as oriented in FIGS. 1 and 2. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

With reference to FIG. 1, the reference numeral 10 generally designates a stack-on panel assembly embodying the present invention, configured for use with panel-based partition systems of the type including at least one base panel 12 with a top portion 14. Stack-on panel assembly 10 includes at least one connector bracket 16 having a first portion 18 shaped for connection with base panel 12 and a second portion 20 upstanding from first portion 18 and having a first latch member 22 thereon. Stack-on panel assembly 10 also includes a stacker panel 24 having a bottom portion 26 shaped for abutting support on top portion 14 of base panel 12, and including at least one vertically extending slot 28 disposed along one side thereof to receive and retain therein second portion 20 of connector bracket 16. A second latch member 30 is disposed within stacker panel 24 at a location adjacent to slot 28 and automatically engages and positively locks with first latch member 22 on connector bracket 16 when stacker panel 24 is lowered into place on top of base panel 12 to positively, yet detachably, connect stacker panel 24 on base panel 12 in a vertically stacked relationship.

Figure 26:
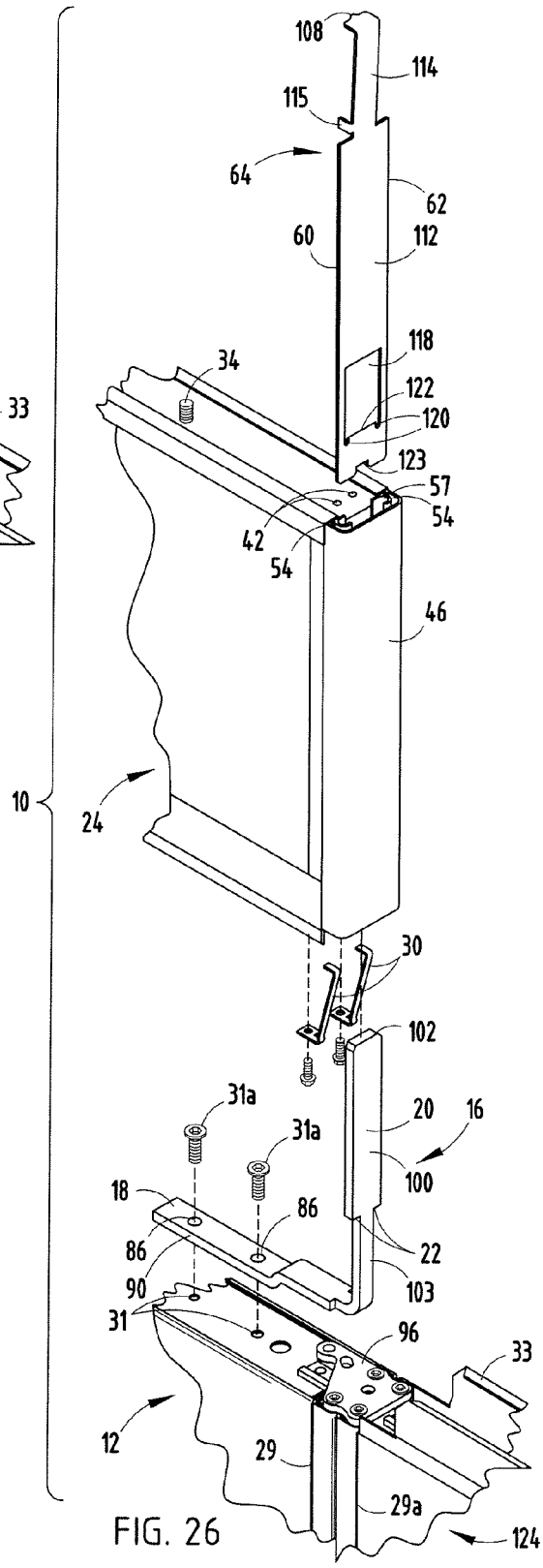
FIG. 26 is a partial exploded top perspective view of one side of the stack-on panel assembly of the instant invention.
Figure 28:
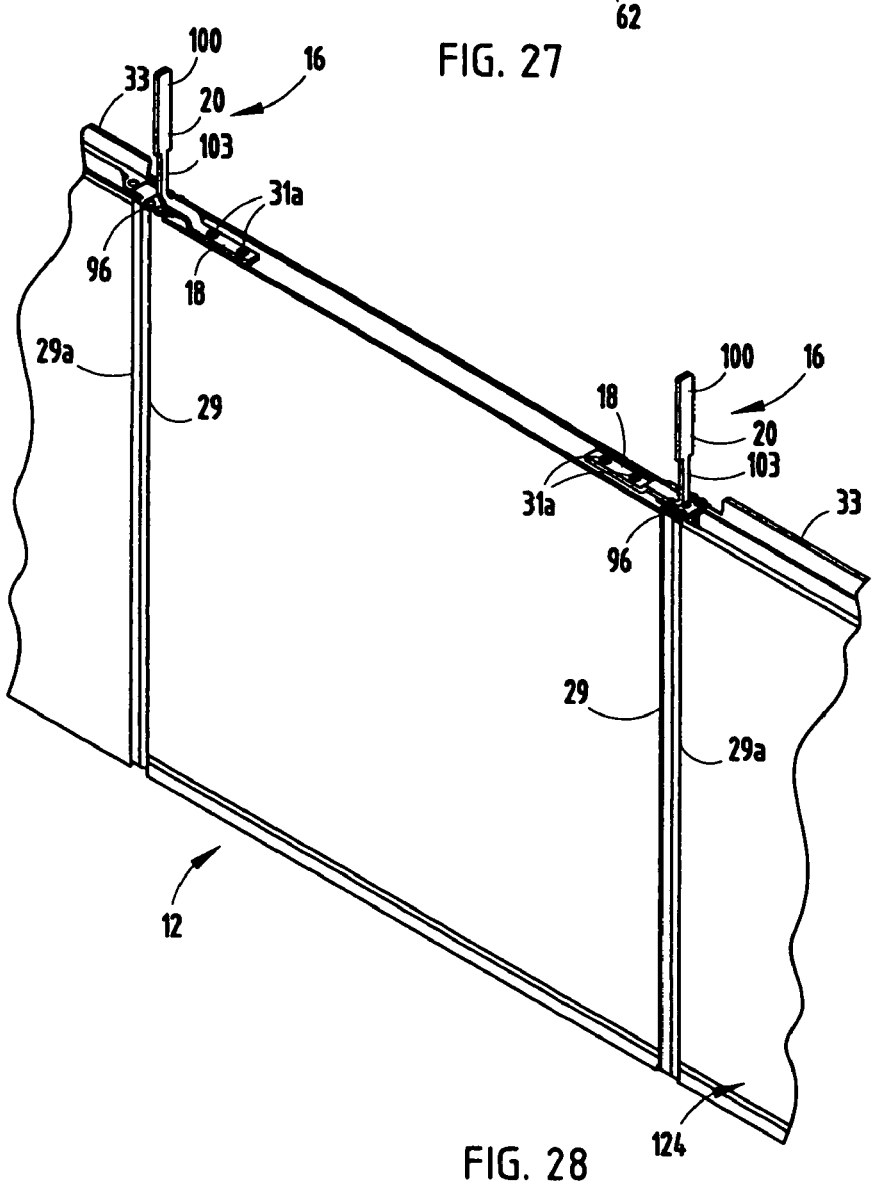
FIG. 28 is a top perspective view of the base panel with two connector brackets secured to the top portion of the base panel.

Referring to FIGS. 26 and 28, base panel 12 includes side portions 29 that are adapted to abut side portions 29*a* of adjacent partition panels. Top portion 14 of base panel 12 is relatively planar and includes fastener apertures 31 (FIG. 26), wherein at least one of the fastener apertures 31 is threaded. The fastener apertures 31 are used, in combination with fasteners 31*a*, to secure a top cap reveal 33 to top portion 14 of base panel 12 or to secure connector bracket 16 to top portion 14 of base panel 12 when stacker panel 24 is being installed. Fasteners 31*a* may be a variety of fastener types including self-threading type screws or traditional threaded screws.

Figure 4:
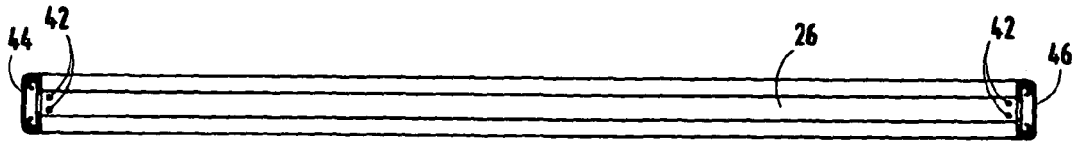
FIG. 4 is a bottom plan view of a stacker panel.
Figure 8:
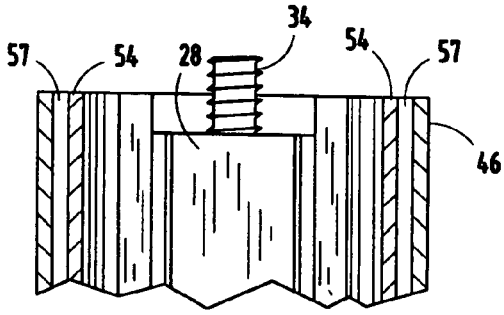
FIG. 8 is an enlarged side elevational view taken at line VIII-VIII of FIG. 7.
Figure 7:
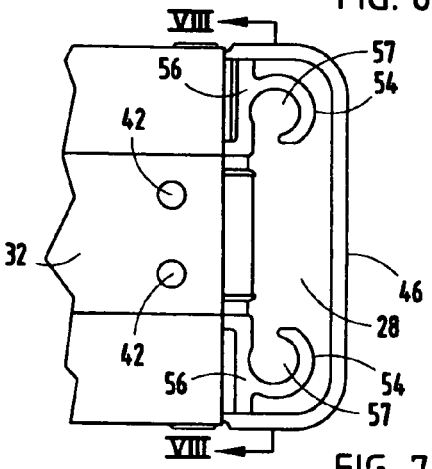
FIG. 7 is an enlarged partial top plan view of one end of the stacker panel.

Referring to FIGS. 1-4, the illustrated stacker panel 24 is particularly adapted for use with Steelcase's Avenir brand partition panel system. As shown in FIGS. 2 and 4, as well as FIGS. 5 and 7, stacker panel 24 has a top portion 32 that is similar in design to bottom portion 26. Top portion 32, however, also includes threaded studs 34, as shown in FIGS. 2 and 8, that are disposed in central frame portion 36 and that are adapted to receive fasteners 38, preferably nuts (FIG. 1).

Fasteners 38 are used to secure a top cap reveal 33 and top cap cover 40 to top portion 32 of stacker panel 24. The top cap reveal 33 is configured to route utilities 41 therethrough. Both top portion 32 and bottom portion 26 of stacker panel 24 include fastener apertures 42 adapted to receive fasteners 43 (FIG. 1). Fastener apertures 42 on bottom portion 26 of stacker panel 24 are used to secure second latch member 30 in place as will be discussed in detail below. Stacker panel 24 includes first and second sides 44, 46, that connect top and bottom portions 32, 26 and are designed to hide and protect the connecting arrangement of stack-on assembly 10. As indicated by the broken line in FIG. 3, stacker panel 24 may be provided in varying heights, depending on the application.

Figure 5:
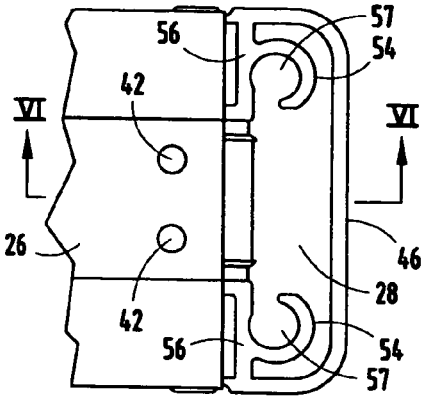
FIG. 5 is an enlarged partial bottom plan view of one end of the stacker panel.
Figure 6:
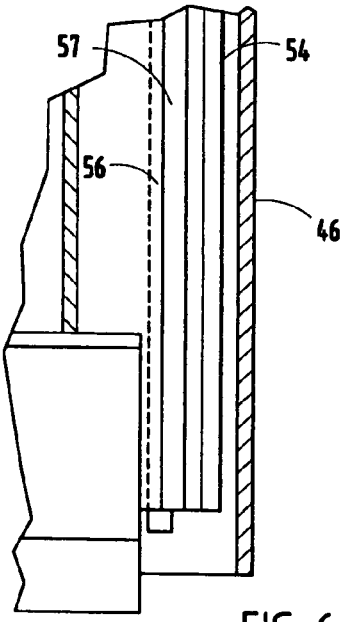
FIG. 6 is an enlarged side elevational view taken at line VI-VI of FIG. 5.
Figure 16:
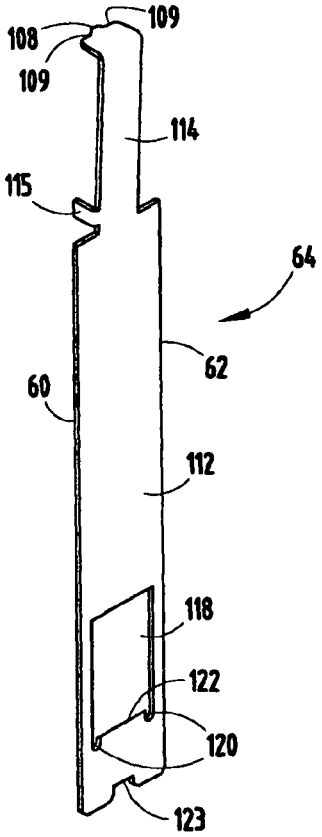
FIG. 16 is a top perspective view of a release member.
Figure 17:
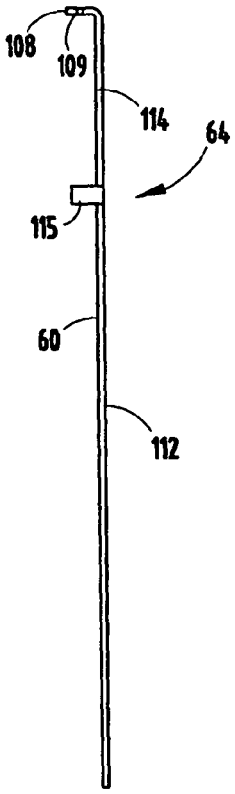
FIG. 17 is a side elevational view of the release member shown in FIG. 16.
Figure 18:
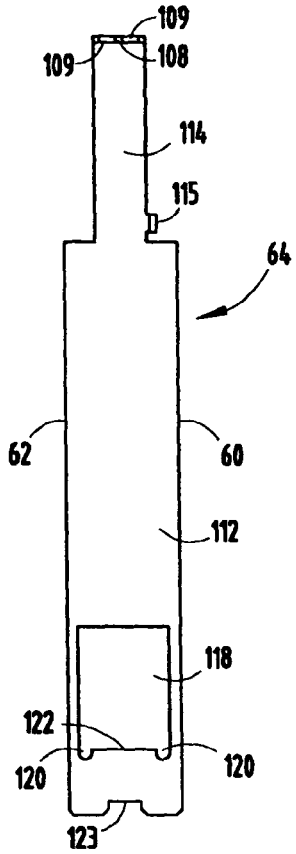
FIG. 18 is a front elevational view of the release member shown in FIG. 16.
Figure 19:
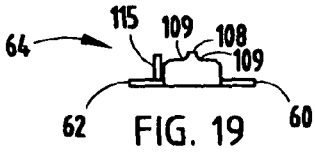
FIG. 19 is a top elevational view of the release member shown in FIG. 16.

As shown in FIGS. 5 and 6, C-shaped receivers 54 are located inside vertically extending slot 28 and attached to inside flanges 56. C-shaped receivers 54 are arranged to face inwardly toward the center of slot 28. C-shaped receivers 54 form rigid channels 57 that extend along each side of the stacker panel from top portion 32 to bottom portion 26 as shown in FIGS. 6 and 8. C-shaped receivers 54 are adapted to receive side edges 60, 62 of a release member 64 (FIG. 16) as discussed further below.

Figure 9:
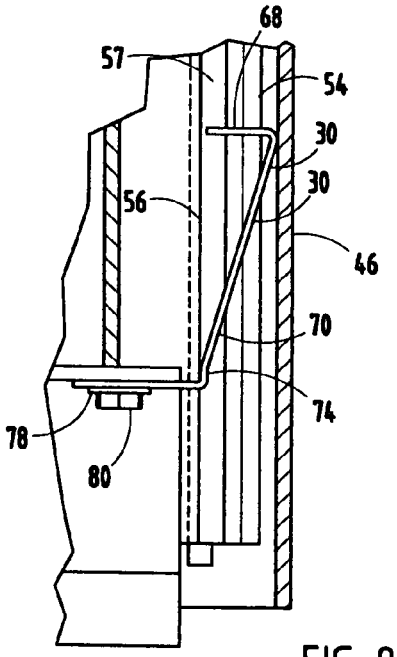
FIG. 9 is the enlarged side elevational view of the one end of the stacker panel shown in FIG. 6, including a latch member.
Figure 10:
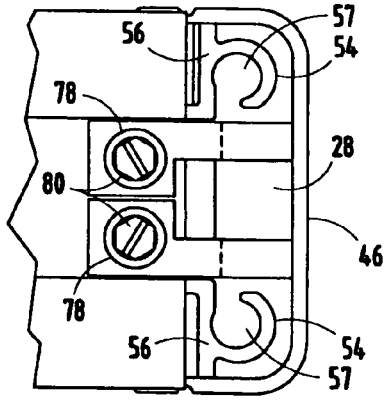
FIG. 10 is an enlarged partial bottom view of the one end of the stacker panel shown in FIG. 9.
Figure 11:
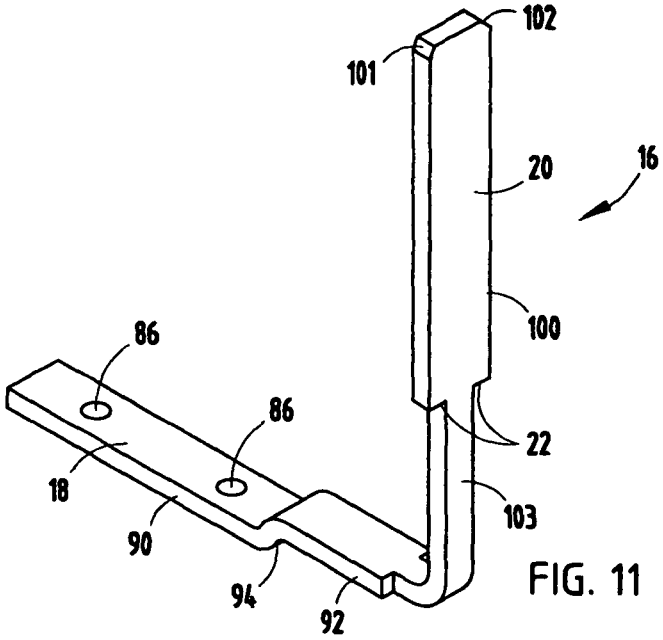
FIG. 11 is a top perspective view of a connector bracket.
Figure 12:
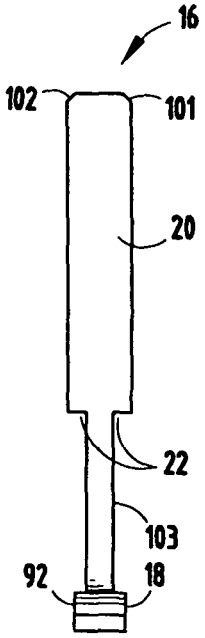
FIG. 12 is a front elevational view of the connector bracket shown in FIG. 11.
Figure 13:
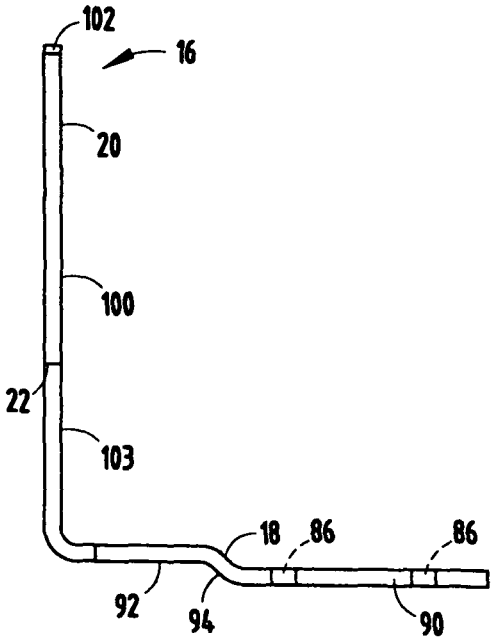
FIG. 13 is a side elevational view of the connector bracket shown in FIG. 11.
Figure 14:
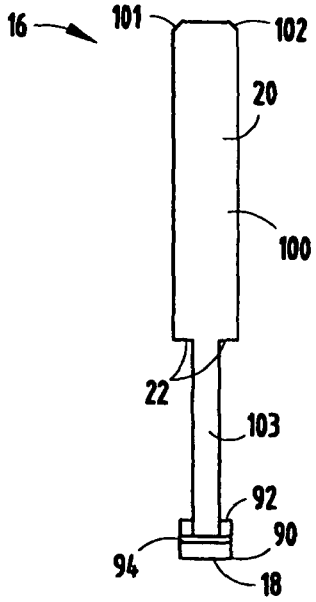
FIG. 14 is a back elevational view of the connector bracket shown in FIG. 11.
Figure 15:
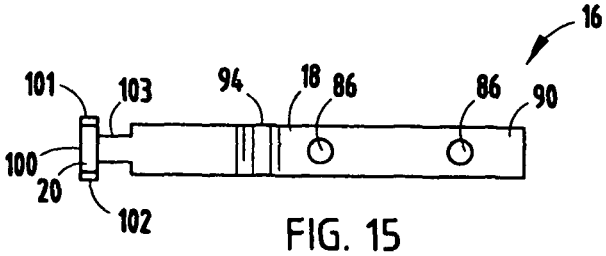
FIG. 15 is a top plan view of the connector bracket shown in FIG. 11.
Figure 20:
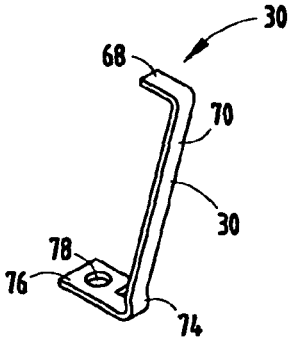
FIG. 20 is a top perspective view of a latch member.
Figure 21:
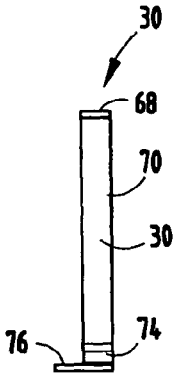
FIG. 21 is a front elevational view of the latch member shown in FIG. 20.
Figure 22:
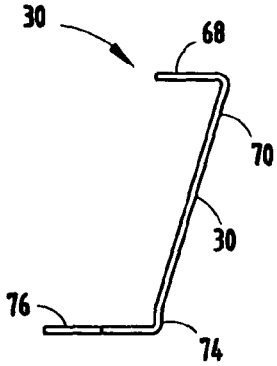
FIG. 22 is a side elevational view of the latch member shown in FIG. 20.
Figure 23:
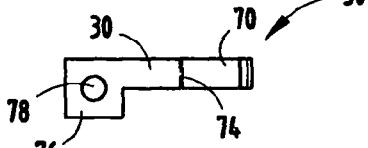
FIG. 23 is a bottom plan view of the latch member shown in FIG. 20.

FIGS. 9 and 10 show the stacker panel latch member 30 extending upwardly at an angle through slot 28, past C-shaped receivers 54 at an angle. Stacker panel spring clips 30 are thin and made from a metal such as steel. Second latch member 30 is in the form of at least one, and possibly two, spring clips having a free end portion 68. Referring to FIGS. 21 and 22, free end portion 68 is connected to a vertically extending member 70 at an acute angle. Vertically extending member 70 includes a straightened portion 74 that is connected with an offset square fastener end 76 as shown in FIGS. 20 and 23. Fastener end 76 includes a fastener aperture 78 so that stacker panel spring clip 30 can be secured by fasteners 80 (FIGS. 9 and 10) to bottom portion 26 of stacker panel 24. The planar extent of free end portion 68 and the planar extent of offset square fastener end 76 are substantially parallel. Stacker panel spring clips 30 are normally biased into vertically extending slot 28. This construction allows stacker panel spring clips 30 to lockingly engage first latch member 22, as will be described in further detail below.

Figure 24:
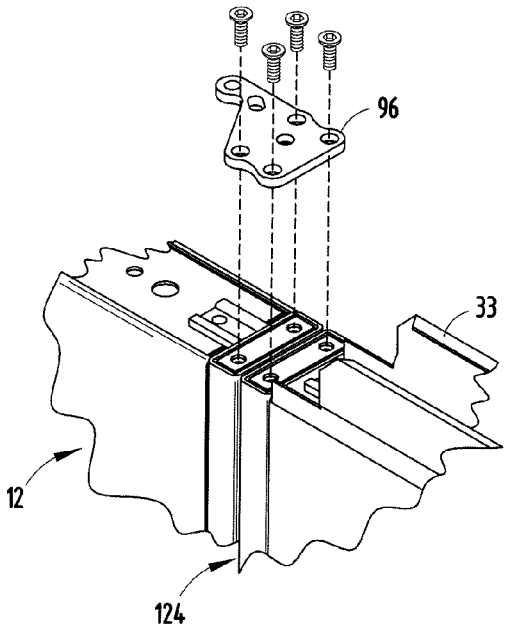
FIG. 24 is a partial top perspective view of adjacent base panels prior to connection with a pork chop bracket.
Figure 25:
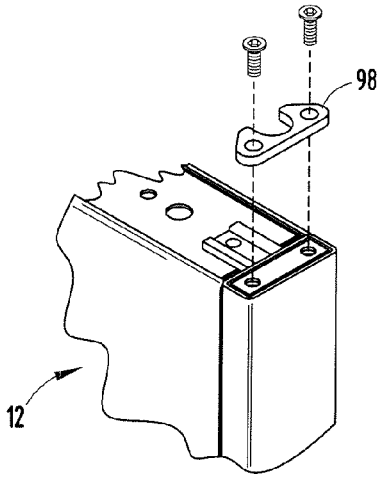
FIG. 25 is a partial top perspective view of a base panel prior to connection with an end-of-run bracket.

As shown in FIGS. 11-15, the illustrated connector bracket 16 has an L-shaped side elevational configuration and includes a first portion 18 in the form of a generally horizontal leg and a second portion 20 in the form of a generally vertical leg. Horizontal leg 18 includes vertically oriented fastener apertures 86. Referring to FIG. 26, two of the vertically oriented fastener apertures 86 are located in horizontal leg 18 and are adapted to receive fasteners 31*a*. Fasteners 31*a* are shaped to be anchored in top portion 14 of base panel 12 to detachably mount connector bracket 16 on base panel 12. Horizontal leg 18 also has first and second segments 90, 92 that are connected by a transition portion 94. The second segment 92 is raised above the first segment 90 and therefore the first and second segments 90, 92 are generally parallel, but not coplanar. This construction allows for connector bracket 16 to easily accommodate a pork chop bracket 96 or end-of-run bracket 98 as illustrated in FIGS. 24 and 25, and discussed further below. Vertical leg 20 of connector bracket 16 includes a blade-shaped upper end 100 configured for close reception in slot 28 (FIGS. 1 and 5). The blade-shaped upper end 100 includes upper tapered corners 101, 102. In addition, vertical leg 20 of connector bracket 16 includes a neck-shaped lower end 103 having a width smaller than the width of blade-shaped upper end 100 to define the latch shoulder member 22 therebetween. Latch shoulder member 22 is located on opposite sides of connector bracket 16. Latch shoulder member 22 is adapted to positively, yet detachably engage the stacker panel spring clip 30.

Figure 27:
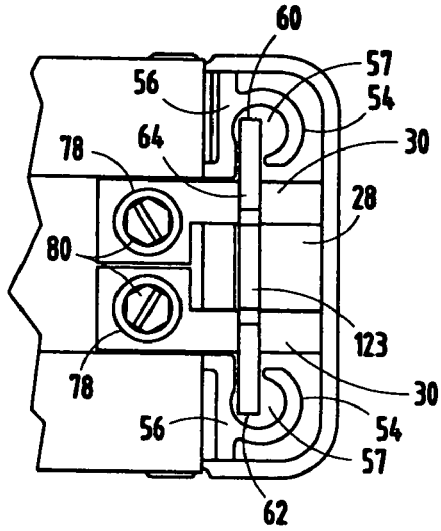
FIG. 27 is an enlarged partial bottom plan view of one side of the stacker panel with spring clips and a release member in place.

Referring to FIGS. 16-19, release member 64 is in the form of a release bracket having a tab portion 108 defined by an inwardly extending tab that projects approximately orthogonally to a rectangular body 112. Tab portion 108 includes rounded indents 109 that allow the tab portion 108 to rest on an exterior part of top portion 14 of stacker panel 24, between top screws 113, when release member 64 has been installed in stacker panel 24. A second portion includes a neck 114 attached to rectangular body 112. The neck includes an anti-dislodgement tab 115 that prevents complete removal of the release bracket 64 from the stacker panel 24. Side edges 60, 62 of release bracket 64 are adapted to be received in C-shaped receivers 54, as shown in FIG. 27. Neck 114 is bent at a slight angle relative to rectangular body 112, such that neck 114 is biased to a position that is not coplanar with the rectangular body 112. Rectangular body 112 includes a substantially rectangular window 118 that includes two open notches 120 on either side of an angled end edge 122. A rectangular indent 123 is located on a bottom edge of the rectangular body 112. As with stacker panel 24, release bracket 64 comes in various lengths to accommodate various height stacker panels 24.

Referring now to FIG. 24, to assemble the stack-on assembly 10, pork chop bracket 96 is secured to base panel 12 and to an adjacent panel 124. Pork chop bracket 96 includes seven fastener apertures of which four are used to secure base panel 12 to an adjacent panel. Two fasteners are anchored in base panel 12 and two fasteners are anchored in the adjacent panel in an in-line or aligned application. Alternatively, as shown in FIG. 25, end-of-run bracket 98 (sometimes referred to as a mustache bracket) can be used.

Referring again to FIG. 26, the components of one side of stack-on assembly 10 with release bracket 64, stacker panel 24, stacker panel spring clip 30, connector bracket 16 and base panel 12 are illustrated in an exploded view. To install the release bracket 64, fasteners 43 are removed so that top portion 32 of the stacker panel 24 may be disconnected from the stacker panel 24. Once top portion 32 is removed, side edges 60, 62 of release bracket 64 are slidably mounted in stacker panel 24 from the top, between C-shaped receivers 54 and reciprocate between locked and unlocked positions 130, 132, shown in FIGS. 33 and 31, respectively. The entire release bracket 64, except for the inwardly oriented tab portion 108 and anti-dislodgement tab 115, slides between C-shaped receivers 54. Stacker panel spring clips 30 are then fastened inside the stacker panel 24 and extend into vertically extending slot 28 (FIG. 27). The blade-shaped upper end 100 of the vertical leg 20 is configured for close reception in slot 28 of stacker panel 24.

Referring to FIG. 28, a single connector bracket 16 is anchored to both ends of base panel 12 by fasteners 31*a* that are shaped to be anchored in top portion 14 of base panel 12.

Fasteners 31*a* detachably mount connector bracket 16 on base panel 12. The generally parallel, non-coplanar construction of first and second segments 90, 92 (FIGS. 11-15) of each connector bracket 16 easily accommodates pork chop bracket 96 secured underneath second segment 92 of connector bracket 16 at either end of base panel 12. Second segment 92 is elevated a distance approximately equal to the thickness of pork chop bracket 96 (or end-of-run bracket 98, if used) by transition portion 94. As a result, the bottom side of first segment 90 abuts and rests on top portion 14 of base panel 12, while second segment 92 and a portion of the neck-shaped lower end 103 of bracket 16 are disposed above pork chop bracket 96.

Figure 29:
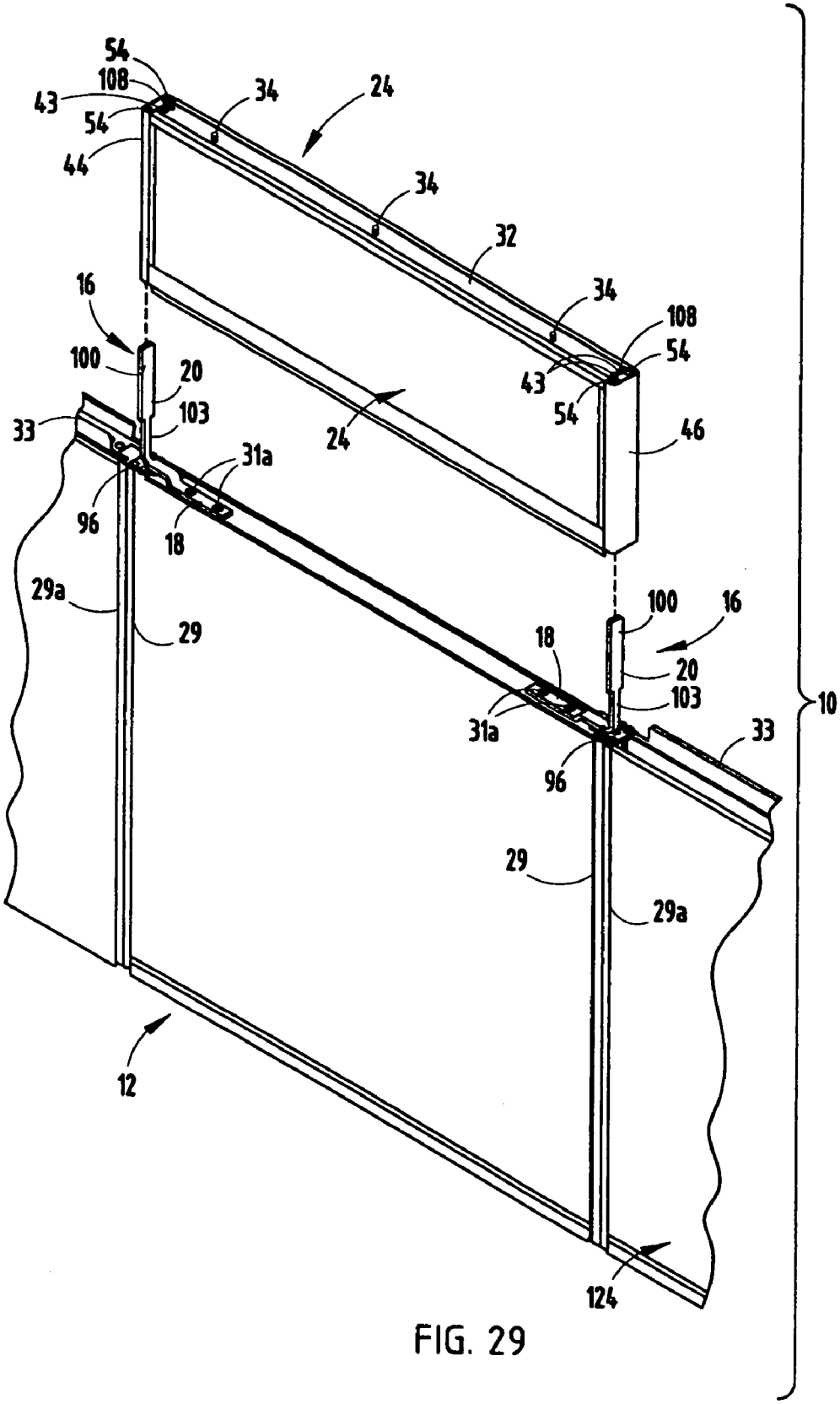
FIG. 29 is a partial top perspective view of the stacker panel prior to engagement with the base panel.

Referring to FIG. 29, after connector brackets 16 are fastened to base panel 12, stacker panel 24 is oriented above base panel 12 so that vertically extending slots 28 on each end of stacker panel 24 are directly above connector brackets 16. Stacker panel 24 is lowered on connector brackets 16 so that vertical blade-shaped upper end 100 of second portion 20 of connector bracket 16 slides into vertically extending slots 28 on both sides of stacker panel 24 (FIG. 30).

Figure 30:
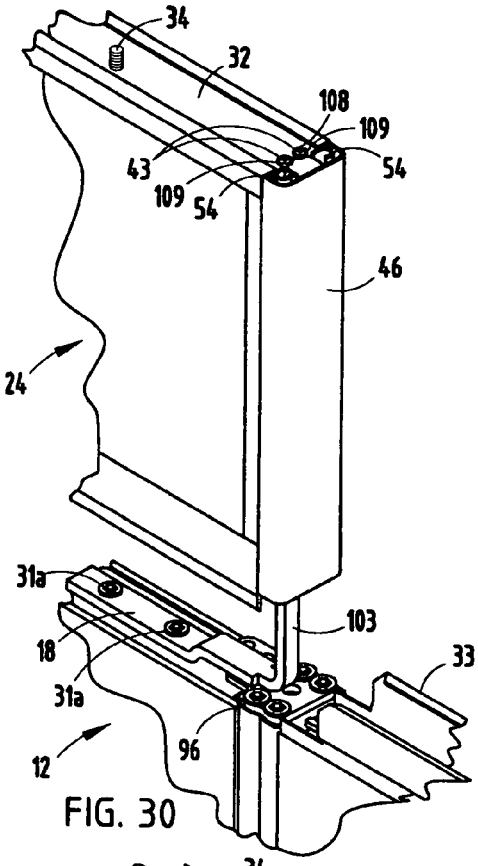
FIG. 30 is a partial top perspective view of the stacker panel partially engaged with the connector bracket above the base panel.
Figure 31:
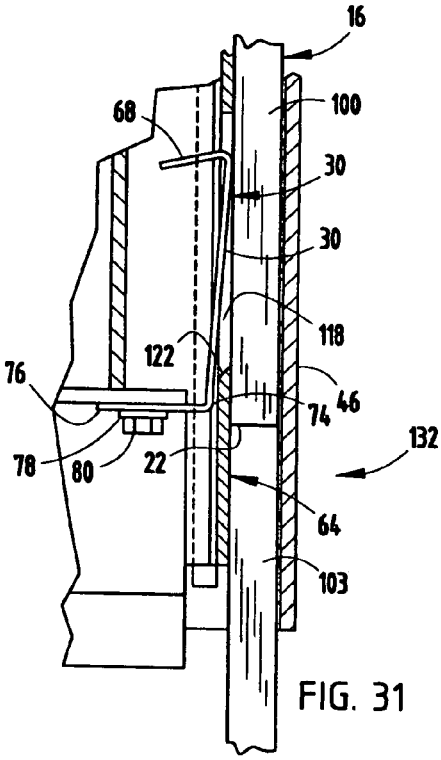
FIG. 31 is an enlarged partial cross-sectional side elevational view of the stacker panel of FIG. 30, partially engaged with the connector bracket.

As shown in FIG. 30, stacker panel 24 continues to be lowered, which results in the vertical blade-shaped portion of connector bracket 16 forcing free end portion 68 of stacker panel spring clip 30 inwardly, through window 118, toward the interior of stacker panel 24 and away from vertically extending slot 28 (FIG. 31). Free end portion 68 of stacker panel spring clip 30 continues to be forced inwardly until latch shoulder member 22 below the blade-shaped upper end 100 of vertical leg 20 of connector bracket 16 passes by stacker panel spring clip 30. When blade-shaped upper end 100 of connector bracket 16 passes stacker panel spring clip 30, bottom portion 26 of stacker panel 24 simultaneously contacts top portion 14 of base panel 12 (FIG. 32).

Figure 32:
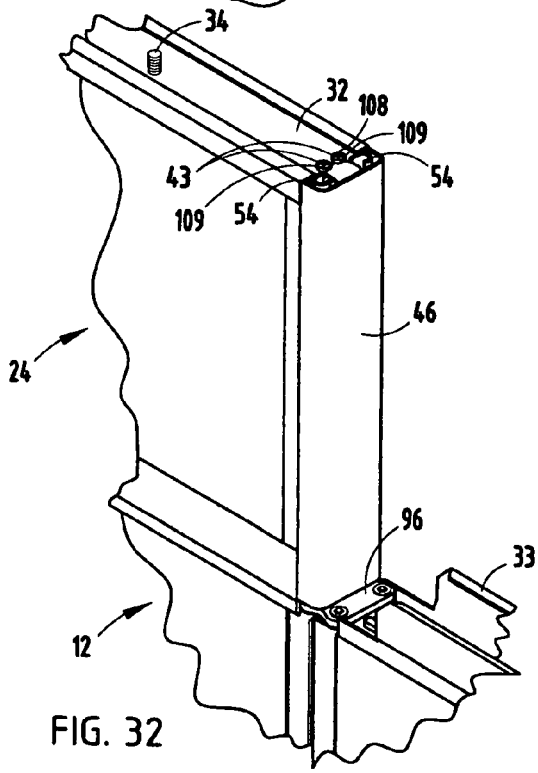
FIG. 32 is a partial top perspective view of the stacker panel fully engaged with the connector bracket and secured to the base panel.
Figure 33:
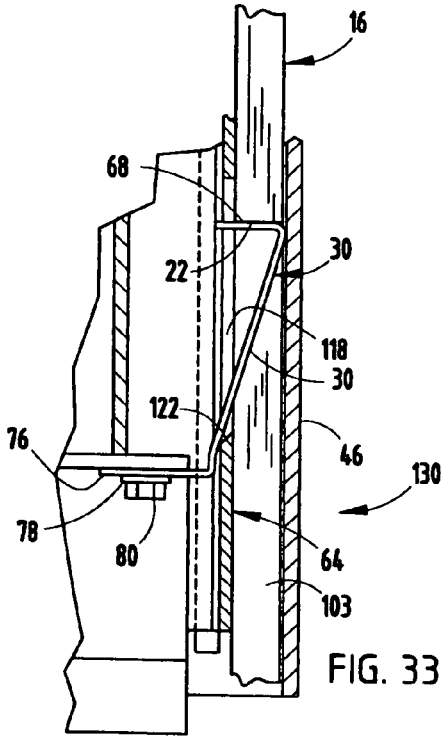
FIG. 33 is an enlarged partial cross-sectional side elevational view of the stacker panel of FIG. 32, fully engaged with the connector bracket.
Figure 34:
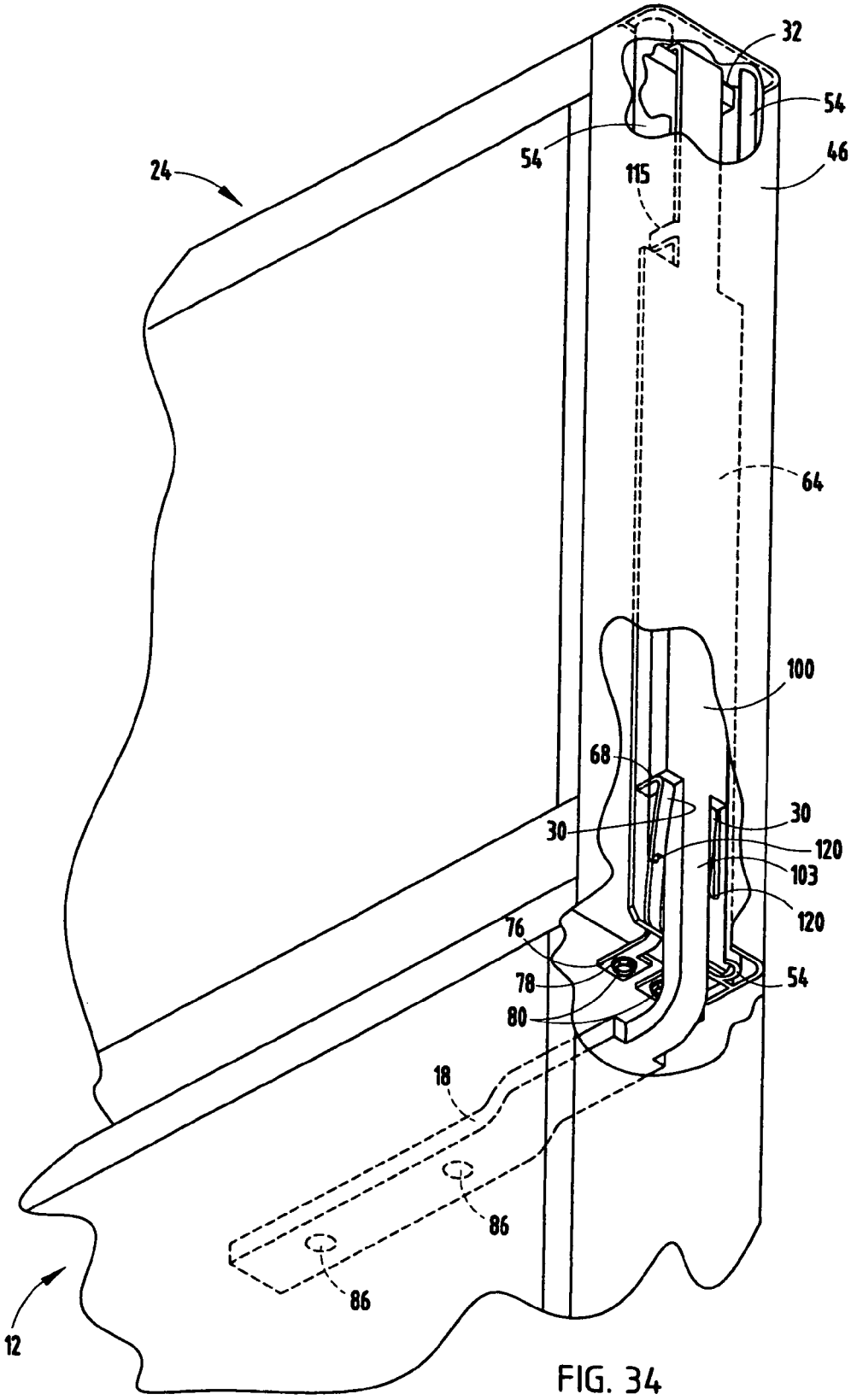
FIG. 34 is an enlarged partial bottom perspective view of the stacker panel fully engaged with the connector bracket and secured to the base panel.

As shown in FIGS. 32 and 33, when stacker panel spring clip 30 clears latch shoulder member 22 of blade-shaped upper end 100, free end portion 68 of stacker panel spring clip 30 snaps back into vertically extending slot 28 and emits an audible confirmation that stacker panel 24 is locked in place (FIG. 33). Stacker panel spring clip 30 passes through window 118 of release bracket 64 and rests against end edge 122 of window 118. The release bracket 64 is in a locked position 130. First portion 18 of release bracket 64 is secured at a position below top portion 14 of stacker panel 24. Free end portion 68 of stacker panel spring clip 30 extends into vertically extending slot 28. Latch shoulder member 22 is shaped for mating abutment with free end portion 68 of stacker panel spring clip 30. This construction creates an interference fit between free end portion 68 of stacker panel spring clip 30 and latch shoulder member 22 of connector bracket 16 that prohibits stacker panel 24 from being removed from base panel 12. Thus, as illustrated in FIG. 34, base panel 12 is positively, yet detachably, connected to stacker panel 24 on base panel 12 in a vertically stacked relationship.

Figure 35:
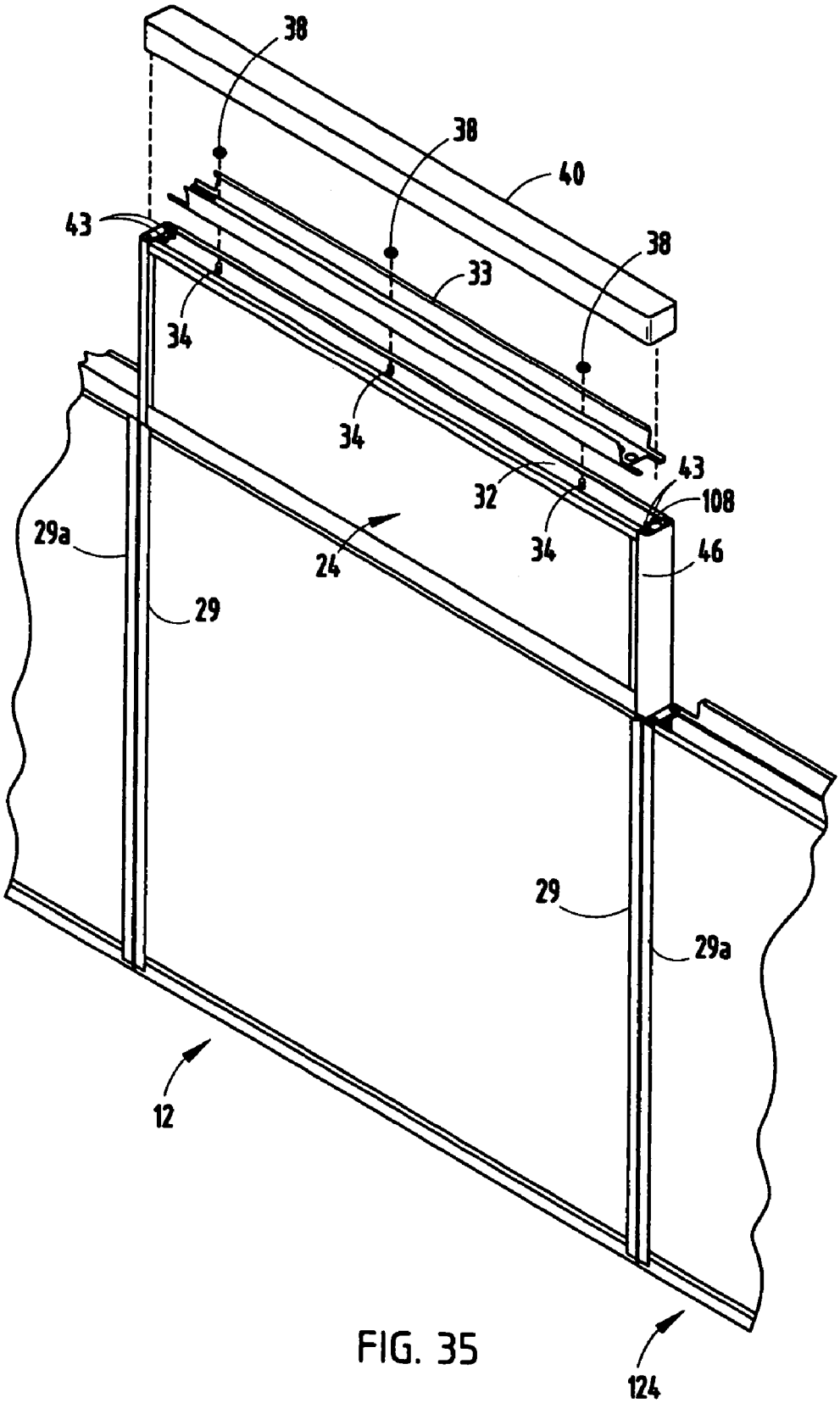
FIG. 35 is a top perspective view of the stacker panel secured to the base panel prior to engagement with the top cap reveal and top cap cover.

Referring to FIG. 35, top cap reveal 33 may be removed from the base panel 12 during installation of stacker panel 24 and fastened to top portion 32 of stacker panel 24 by fasteners 38. The top cap reveal 33 includes a channel-like configuration for routing utilities 41. In addition, top cap cover 40 may be fastened to top cap reveal 33. Once in place, assembly of the stack-on assembly 10 is complete.

Figure 36:
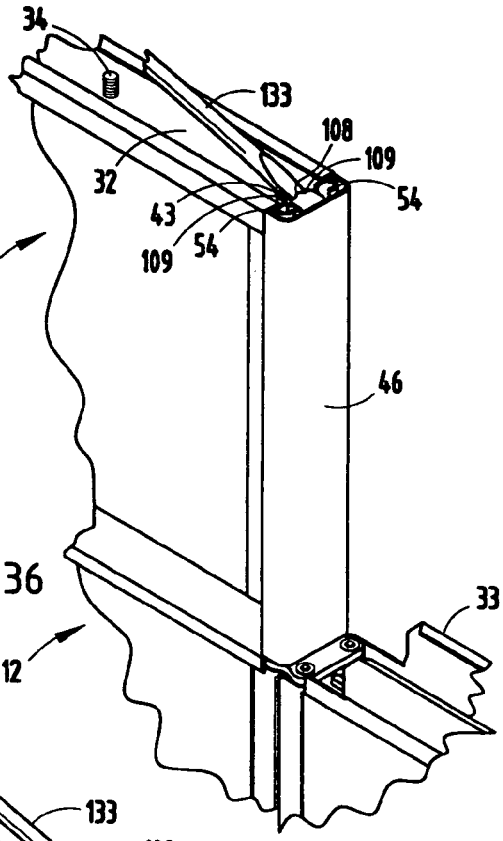
FIG. 36 is a partial top perspective view of the stacker panel fully engaged with the connector bracket prior to removal of the stacker panel from the base panel.
Figure 37:
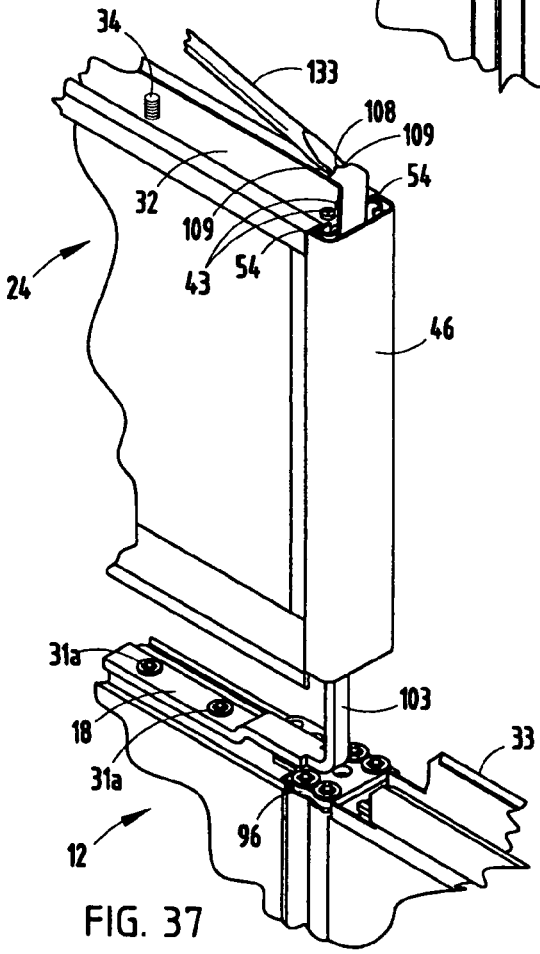
FIG. 37 is a partial top perspective view of the stacker panel during removal of the stacker panel from the base panel.
Figure 38:
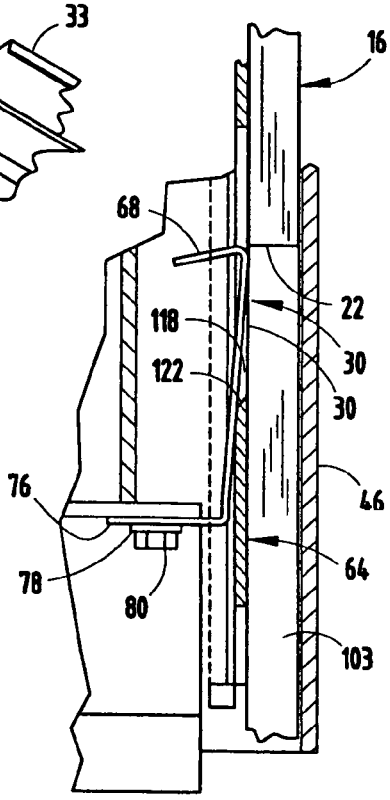
FIG. 38 is an enlarged partial cross-sectional side elevational view of the bottom of the stacker panel during removal of the stacker panel from the base panel.
Figure 39:
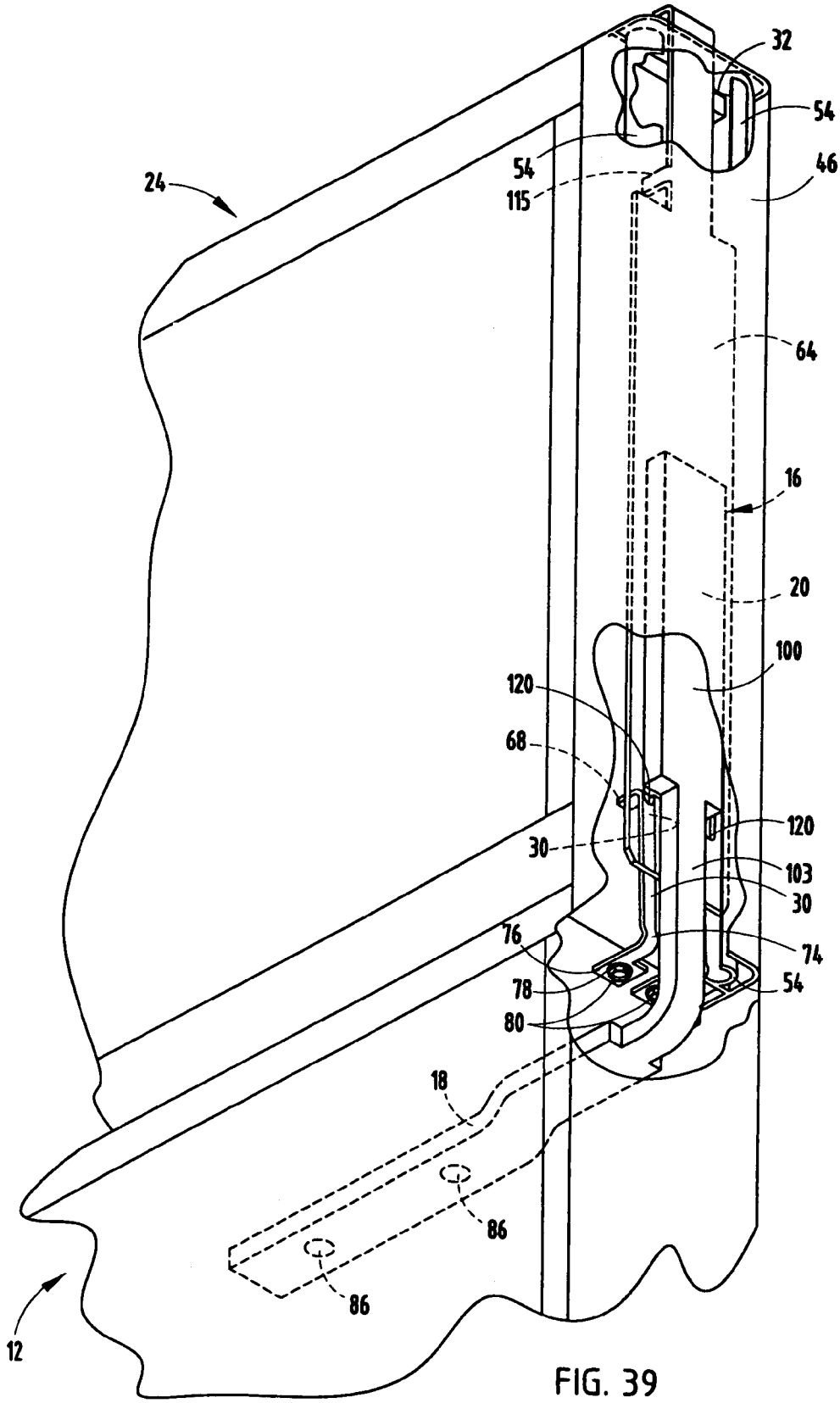
FIG. 39 is an enlarged partial bottom perspective view of the stacker panel being disengaged from the connector bracket.

As shown in FIG. 36, to remove stacker panel 24, the installer simply inserts an elongate tool 133, such as a screwdriver, underneath inwardly oriented tab portion 108. Tab portion 108 should be lifted so that release bracket 64 slides upwardly inside C-shaped receivers 54. As release bracket 64 slides upwardly (FIGS. 37), window 118 through which stacker panel spring clip 30 extends, also slides upwardly. As window 118 slides upwardly, end edge 122 of window 118, which is abuttingly engaged with stacker panel spring clip 30, slides upwardly pushing stacker panel spring clip 30 inwardly toward the interior of base panel 12. The angled orientation of the end edge 122 pushing on the stacker panel spring clip 30 minimizes damage to the stacker panel spring clip 30. Stacker panel spring clip 30 continues to be pushed inwardly toward the interior of stacker panel 24 until free end portion 68 of stacker panel spring clip 30 is no longer in the vertically extending slot 28, as shown in FIGS. 38 and 39. The release bracket 64 is now in an unlocked position 132. Once free end portion 68 of stacker panel spring clip 30 is no longer in vertically extending slot 28 and no longer abutting latch shoulder member 22 of blade-shaped upper portion 100 of connector bracket 16, stacker panel spring clips 30 are free to move upwardly past latch shoulder member 22. Accordingly, stacker panel 24 along with stacker panel spring clips 30 may be freely lifted from its resting position on base panel 12.

Figure 39A:
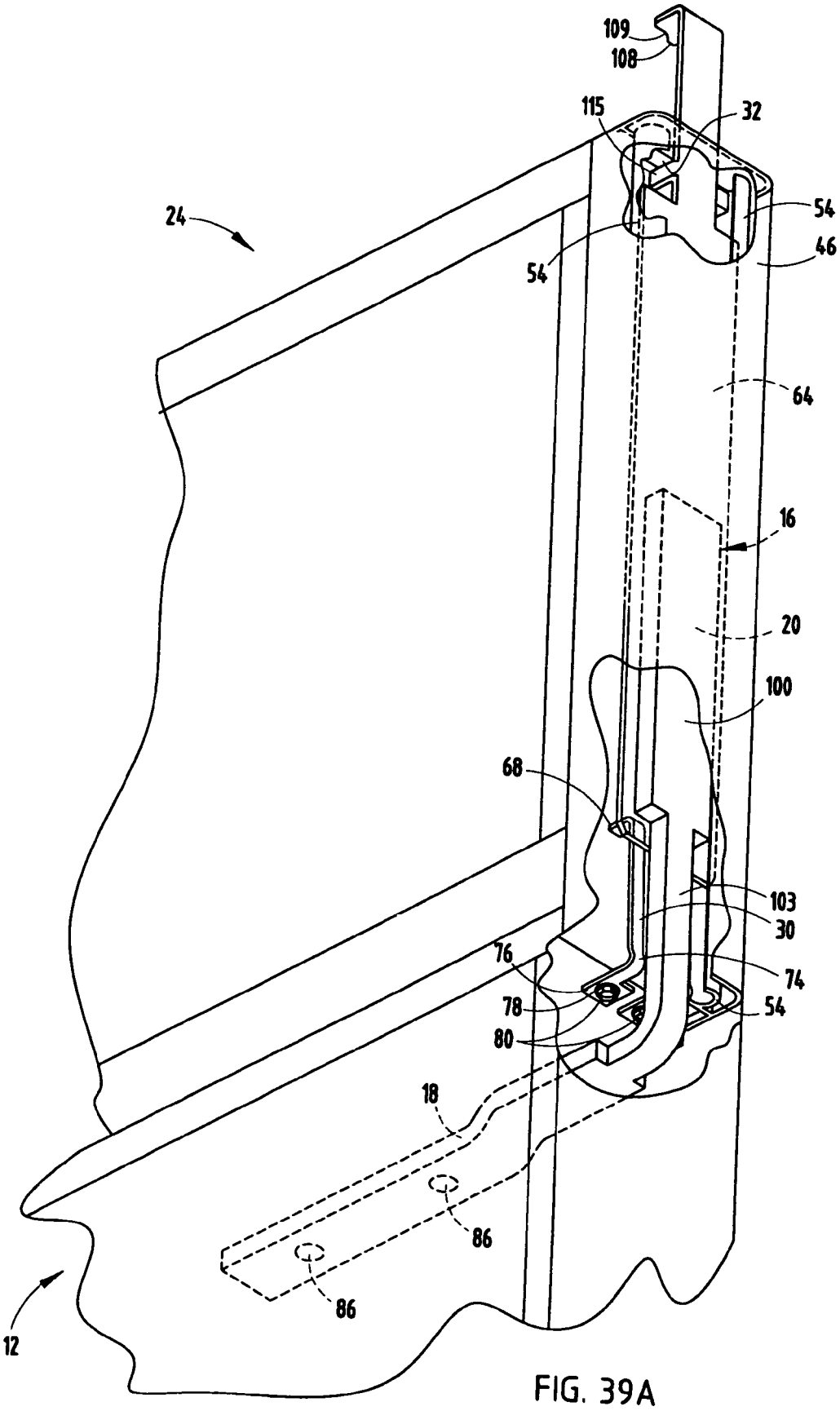
FIG. 39A is an enlarged partial bottom perspective view of the stacker panel with the release member abutting the top of the stacker panel.

As illustrated in FIG. 39A, the tab portion 108 of release bracket 64 may be lifted by a user until anti-dislodgement tab 115 engages the underside of the top portion 32 of the stacker panel 24. Accordingly, anti-dislodgement tab 115 prevents release bracket 64 from being completely removed from the stacker panel 24. When the anti-dislodgement tab 115 has reached and abuts the underside of top portion 32, release bracket 64 is still in an unlocked position 132, and hence the stacker panel 24 may still be free lifted from its resting position on base panel 12.

Figure 40:
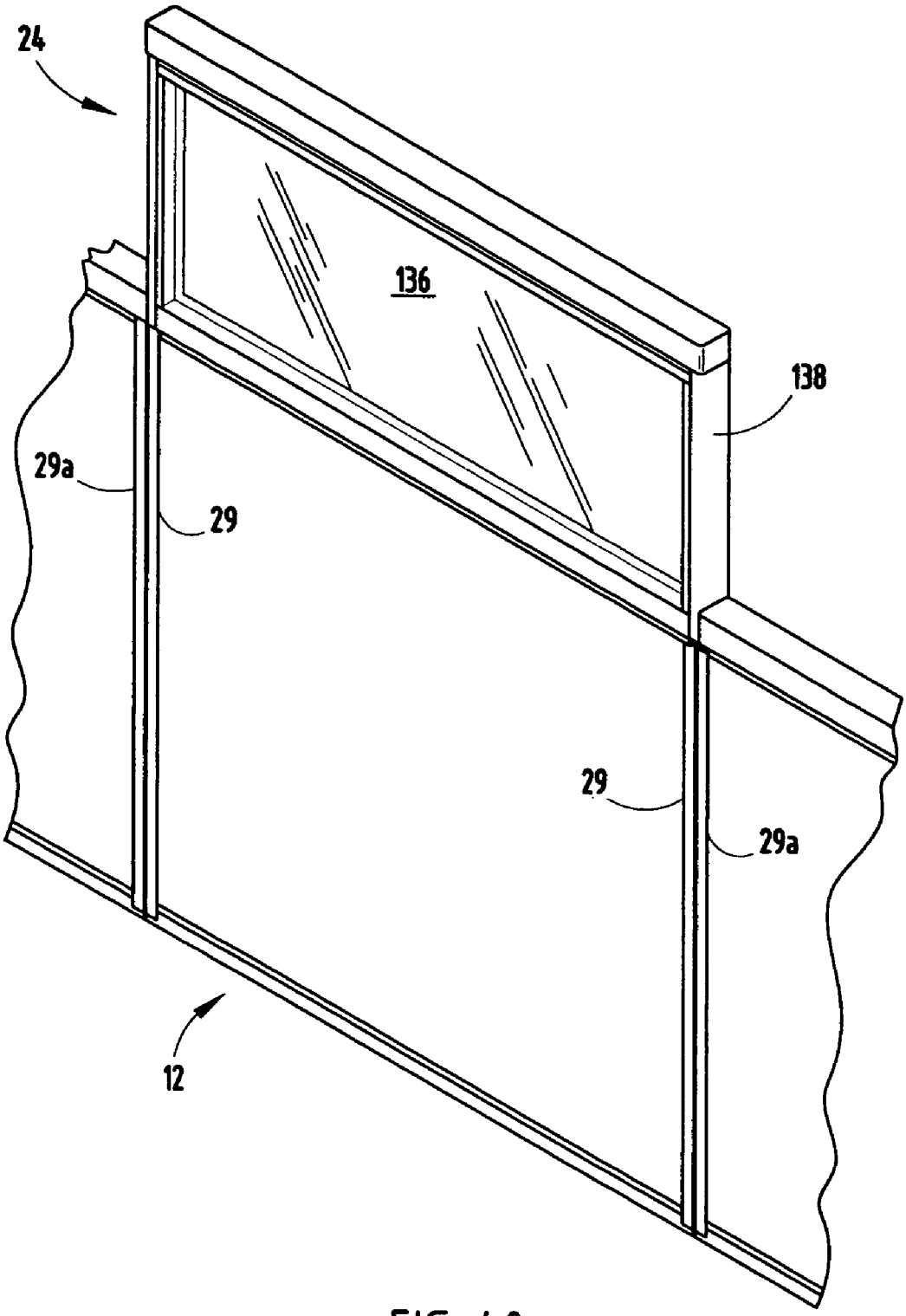
FIG. 40 is a top perspective view of a stacker panel having a central transparent panel.

Referring now to FIG. 40, stacker panel 24 may include a central transparent panel 136 mounted in a marginal frame 138. Central transparent panel 136 allows light to pass through into adjacent work areas while limiting noise passing to those areas.

Figure 41:
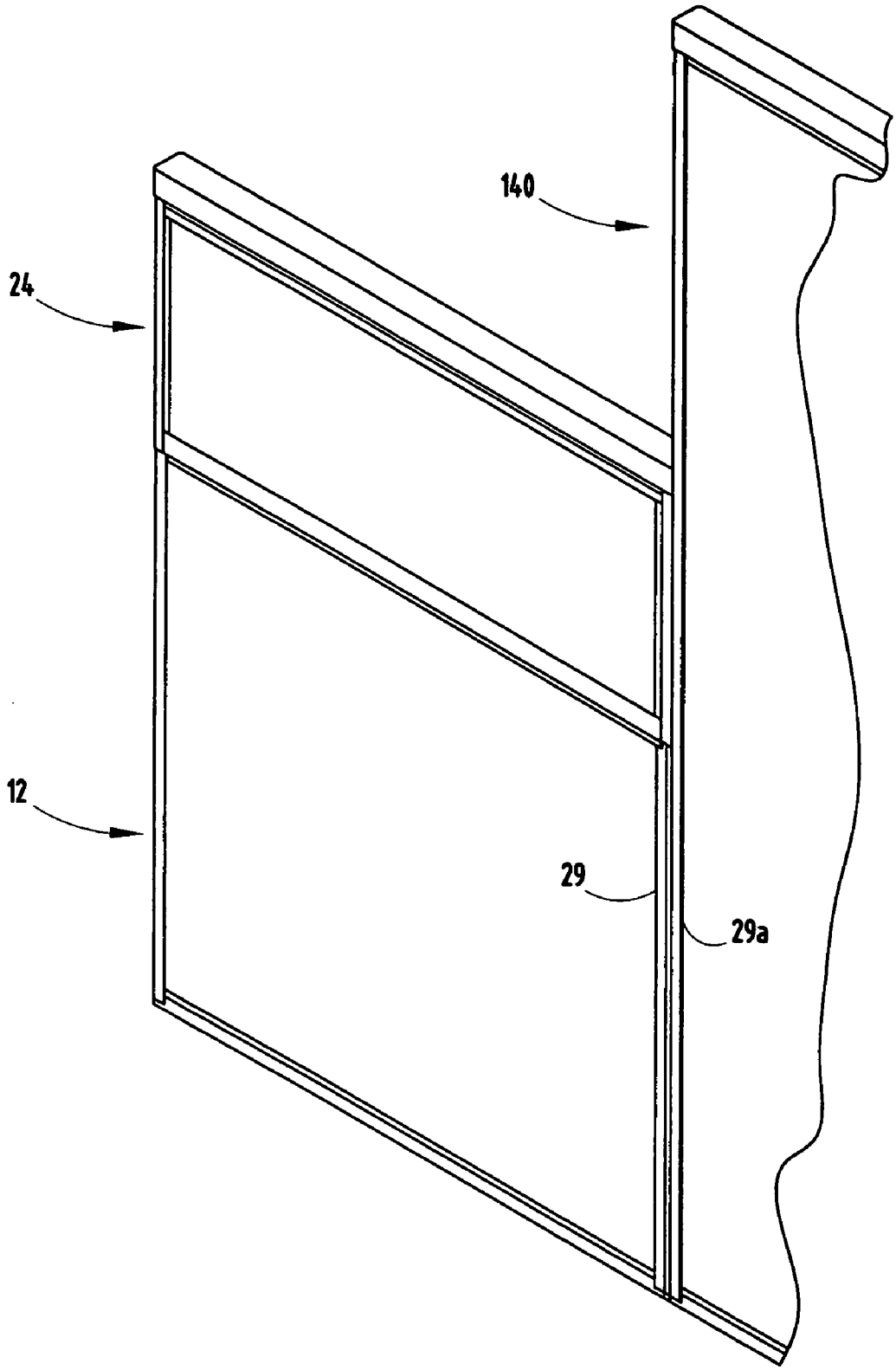
FIG. 41 is a top perspective view of a stacker panel secured to a base panel and adjacent another panel assembly.

As shown in FIG. 41, stack-on assembly 10 may be adjacent to a larger partition panel assembly 140. In this arrangement, stacker panel 24 can still be removed, simply by removing the top cap cover 40 and tab portion 108 of release member 64 (FIG. 36).

It is to be understood that variations and modifications can be made to the aforementioned structure without departing from the concepts of the present invention, and further it is to be understood that such concepts are intended to be covered by the following claims unless these claims by their language expressly state otherwise.

The invention claimed is:

1. A stack-on panel assembly for panel-based partition systems of the type including at least one base panel with a top portion, comprising:

at least one connector bracket having a first portion thereof shaped for connection with the base panel and a second portion thereof upstanding from said first portion and having a first latch member thereon;

a stacker panel having a bottom portion thereof shaped for abutting support on the top portion of said base panel, and including at least one vertically extending slot disposed along one side thereof to receive and selectively retain therein said second portion of said connector bracket;

a second latch member disposed within said stacker panel at a location adjacent to said slot and being automatically spring biased into positive locking engagement with said first latch member on said connector bracket when said stacker panel is lowered into place on top of the base panel to positively retain said stacker panel on the base panel in a vertically stacked relationship, whereby said stacker panel cannot be removed from the base panel without first unlocking the positive engagement between said first and second latch members; and a release member mounted in said stacker panel for shifting between locked and unlocked positions, and having a portion thereof disposed adjacent to said slot and configured to disengage the positive engagement between said first and second latch members when said release member is shifted to said unlocked position, thereby permitting said stacker panel to be removed from the base panel, wherein said release member includes a window through which a free end portion of said second latch member projects to engage said first latch member on said connecter bracket when said release bracket is in said locked position.

2. A stack-on panel assembly as set forth in claim 1, wherein said release member is movably mounted in said stacker panel, and has a first portion thereof disposed exterior to said stacker panel and configured to facilitate shifting said release member between said locked and unlocked positions.

3. A stack-on panel assembly as set forth in claim 2, wherein:

said second latch member comprises a spring clip which is normally biased into locking engagement with said first latch member.

4. A stack-on panel assembly as set forth in claim 3, wherein:

said first latch member is defined by a shoulder disposed on said second portion of said connector bracket and shaped for mating abutment with a free end portion of said spring clip.

5. A stack-on panel assembly as set forth in claim 4, wherein:

said stacker panel is configured to be mounted on top of the base panel with said release member in said locked position such that said spring clip automatically snaps into engagement with said shoulder when said stacker panel is lowered into place on top of the base panel, and thereby emits an audible confirmation that said stacker panel is locked into place.

6. A stack-on panel assembly as set forth in claim 5, wherein:

said release member comprises a release bracket slidably mounted in said stacker panel for generally vertical reciprocation between said locked and unlocked positions.

7. A stack-on panel assembly as set forth in claim 6, wherein:

said release bracket includes a window through which said free end portion of said spring clip projects to engage said shoulder on said connector bracket when said release bracket is in said locked position.

8. A stack-on panel assembly as set forth in claim 7, wherein:

said window on said release bracket is defined in part by an end edge configured to abut said free end portion of said spring clip when said release bracket is shifted to said unlocked position to thereby disengage said spring clip from said shoulder.

9. A stack-on panel assembly as set forth in claim 8, wherein:

said connector bracket has a generally L-shaped side elevational configuration with a generally horizontal leg defining said first portion thereof and shaped for connection with the top portion of the base panel, and a generally vertical leg defining said second portion thereof and disposed generally perpendicular to said horizontal leg.

10. A stack-on panel assembly as set forth in claim 9, wherein:

said connector bracket includes at least one vertically oriented fastener aperture through said horizontal leg; and including at least one fastener extending through said fastener aperture and shaped to be anchored in the top portion of the base panel to detachably mount said connector bracket on the base panel.

11. A stack-on panel assembly as set forth in claim 10, wherein:

said vertical leg of said connector bracket includes a blade-shaped upper end configured for close reception in said slot.

12. A stack-on panel assembly as set forth in claim 11, wherein:

said vertical leg of said connector bracket includes a neck-shaped lower end having a width smaller than the width of said blade-shaped upper end to define said shoulder therebetween.

13. A stack-on panel assembly as set forth in claim 12, wherein:

said stack-on panel assembly includes a pair of said connector brackets shaped for connection with opposite sides of the base panel; and said stacker panel includes a pair of said vertically extending slots disposed adjacent opposite sides thereof in which said second portions of said connector brackets are closely received.

14. A stack-on panel assembly as set forth in claim 13, wherein:

said stacker panel includes a pair of said release brackets slidably mounted in said stacker panel adjacent opposite sides thereof to disengage both of said second latch members from said first latch members.

15. A stack-on panel assembly as set forth in claim 14, wherein:

said first portion of said release member is defined by an inwardly oriented tab positioned adjacent an upper end of said release bracket, and is shaped to facilitate manually shifting said release bracket vertically between said locked and unlocked positions.

16. A stack-on panel assembly as set forth in claim 15, including:

a top cap reveal configured to route utilities therealong and detachably connected with a top portion of said stacker panel; and wherein said top cap reveal is configured to be removed from the base panel and installed on said stacker panel.

17. A stack-on panel assembly as set forth in claim 16, including:

a top cap cover detachably connected with the top portion of said stacker panel and enclosing the same and said top cap reveal; and wherein said top cap cover is configured to be removed from the base panel and installed on said stacker panel.

18. A stack-on panel assembly as set forth in claim 17, wherein:

said fastener is configured to attach said top cap reveal to the base panel, and is removed therefrom and reused to attach said connector bracket to the base panel.

19. A stack-on panel assembly as set forth in claim 1, wherein:

said second latch member comprises a spring clip which is normally biased into locking engagement with said first latch member.

20. A stack-on panel assembly as set forth in claim 1, wherein:

said first latch member is defined by a shoulder disposed on said second portion of said connector bracket and shaped for mating abutment with said second latch member.

21. A stack-on panel assembly as set forth in claim 1, wherein:

said stacker panel is configured to be mounted on top of the base panel with said release member in said locked position such that said second latch member automatically snaps into engagement with said first latch member when said stacker panel is lowered into place on top of the base panel, and thereby emits an audible confirmation that said stacker panel is locked into place.

22. A stack-on panel assembly as set forth in claim 1, wherein:

said release member comprises a release bracket slidably mounted in said stacker panel for generally vertical reciprocation between said locked and unlocked positions.

23. A stack-on panel assembly as set forth in claim 1, wherein:

said window on said release bracket is defined in part by an end edge configured to abut said free end portion of said second latch member when said release bracket is shifted to said unlocked position to thereby disengage said first latch member from said second latch member.

24. A stack-on panel assembly as set forth in claim 1, wherein:

said connector bracket has a generally L-shaped side elevational configuration with a generally horizontal leg defining said first portion thereof and shaped for connection with the top portion of the base panel, and a generally vertical leg defining said second portion thereof and disposed generally perpendicular to said horizontal leg.

25. A stack-on panel assembly as set forth in claim 24, wherein:

said connector bracket includes at least one vertically oriented fastener aperture through said horizontal leg; and including at least one fastener extending through said fastener aperture and shaped to be anchored in the top portion of the base panel to detachably mount said connector bracket on the base panel.

26. A stack-on panel assembly as set forth in claim 24, wherein:

said vertical leg of said connector bracket includes a blade-shaped upper end configured for close reception in said slot.

27. A stack-on panel assembly as set forth in claim 1, wherein:

said stack-on panel assembly includes a pair of said connector brackets shaped for connection with opposite sides of the base panel; and said stacker panel includes a pair of said vertically extending slots disposed adjacent opposite sides thereof in which said second portions of said connector brackets are closely received.

28. A stack-on panel assembly as set forth in claim 1, wherein:

said stacker panel includes a central transparent panel mounted in a marginal frame.

29. In a panel-based partition system of the type including at least one base panel with a top portion, the improvement of a stack-on panel assembly, comprising:

at least one connector bracket having a first portion thereof connected with said base panel and a second portion thereof upstanding from said first portion and having a first latch member thereon;

a stacker panel having a bottom portion thereof abuttingly supported on said top portion of said base panel, and including at least one vertically extending slot disposed along one side thereof to receive and selectively retain therein said second portion of said connector bracket;

a second latch member disposed within said stacker panel at a location adjacent to said slot and being automatically spring biased into positive locking engagement with said first latch member on said connector bracket when said stacker panel is lowered into place on top of said base panel to positively retain said stacker panel on said base panel in a vertically stacked relationship, whereby said stacker panel cannot be removed from said base panel without first unlocking the positive engagement between said first and second latch members; and a release member mounted in said stacker panel for shifting between locked and unlocked positions, and having a portion thereof disposed adjacent to said slot and configured to disengage the positive engagement between said first and second latch members when said release member is shifted to said unlocked position, thereby permitting said stacker panel to be removed from said base panel, said release member includes a window through which a free end portion of said second latch member projects to engage said first latch member on said connector bracket when said release bracket is in said locked postion.

30. A partition system as set forth in claim 29, wherein said release member is movably mounted in said stacker panel, and has a first portion thereof disposed exterior to said stacker panel and configured to facilitate shifting said release member between said locked and unlocked positions.

31. A partition system as set forth in claim 30, wherein:

said second latch member comprises a spring clip which is normally biased into locking engagement with said first latch member.

32. A partition system as set forth in claim 31, wherein:

said first latch member is defined by a shoulder disposed on said second portion of said connector bracket and shaped for mating abutment with a free end portion of said spring clip.

33. A partition system as set forth in claim 32, wherein:

said stacker panel is configured to be mounted on top of said base panel with said release member in said locked position such that said spring clip automatically snaps into engagement with said shoulder when said stacker panel is lowered into place on top of said base panel, and thereby emits an audible confirmation that said stacker panel is locked into place.

34. A partition system as set forth in claim 33, wherein:

said release member comprises a release bracket slidably mounted in said stacker panel for generally vertical reciprocation between said locked and unlocked positions.

35. A partition system as set forth in claim 34, wherein:

said release bracket includes a window through which said free end portion of said spring clip projects to engage said shoulder on said connector bracket when said release bracket is in said locked position.

36. A partition system as set forth in claim 35, wherein:

said window on said release bracket is defined in part by an end edge configured to abut said free end portion of said spring clip when said release bracket is shifted to said unlocked position to thereby disengage said spring clip from said shoulder.

37. A partition system as set forth in claim 36, wherein:

said connector bracket has a generally L-shaped side elevational configuration with a generally horizontal leg defining said first portion thereof and connected with said top portion of said base panel, and a generally vertical leg defining said second portion thereof and disposed generally perpendicular to said horizontal leg.

38. A partition system as set forth in claim 37, wherein:

said connector bracket includes at least one vertically oriented fastener aperture through said horizontal leg; and including at least one fastener extending through said fastener aperture and anchored in said top portion of said base panel to detachably mount said connector bracket on said base panel.

39. A partition system as set forth in claim 38, wherein:

said vertical leg of said connector bracket includes a blade-shaped upper end configured for close reception in said slot.

40. A partition system as set forth in claim 39, wherein:

said vertical leg of said connector bracket includes a neck-shaped lower end having a width smaller than the width of said blade-shaped upper end to define said shoulder therebetween.

41. A partition system as set forth in claim 40, wherein:

said stack-on panel assembly includes a pair of said connector brackets shaped for connection with opposite sides of said base panel; and said stacker panel includes a pair of said vertically extending slots disposed adjacent opposite sides thereof in which said second portions of said connector brackets are closely received.

42. A partition system as set forth in claim 41, wherein:

said stacker panel includes a pair of said release brackets slidably mounted in said stacker panel adjacent opposite sides thereof to disengage both of said second latch members from said first latch members.

43. A partition system as set forth in claim 42, wherein:

said first portion of said release member is defined by an inwardly oriented tab positioned adjacent an upper end of said release bracket, and is shaped to facilitate manually shifting said release bracket vertically between said locked and unlocked positions.

44. A partition system as set forth in claim 43, including:

a top cap reveal configured to route utilities therealong and detachably connected with a top portion of said stacker panel; and wherein said top cap reveal is configured to be removed from said base panel and installed on said stacker panel.

45. A partition system as set forth in claim 44, including:

a top cap cover detachably connected with the top portion of said stacker panel and enclosing the same and said top cap reveal; and wherein said top cap cover is configured to be removed from said base panel and installed on said stacker panel.

46. A partition system as set forth in claim 45, wherein:

said fastener is configured to attach said top cap reveal to said base panel, and is removed therefrom and reused to attach said connector bracket to said base panel.

47. A partition system as set forth in claim 29, including:

a top cap reveal configured to route utilities therealong and detachably connected with a top portion of said stacker panel; and wherein said top cap reveal is configured to be removed from said base panel and installed on said stacker panel.

48. A partition system as set forth in claim 29, including:

a top cap cover detachably connected with the top portion of said stacker panel and enclosing the same; and wherein said top cap cover is configured to be removed from said base panel and installed on said stacker panel.

49. A stack-on panel assembly as set forth in claim 29, wherein:

said second latch member comprises a spring clip which is normally biased into locking engagement with said first latch member.

50. A stack-on panel assembly as set forth in claim 29, wherein:

said first latch member is defined by a shoulder disposed on said second portion of said connector bracket and shaped for mating abutment with said second latch member.

51. A stack-on panel assembly as set forth in claim 29, wherein:

said stacker panel is configured to be mounted on top of said base panel with said release member in said locked position such that said second latch member automatically snaps into engagement with said first latch member when said stacker panel is lowered into place on top of said base panel, and thereby emits an audible confirmation that said stacker panel is locked into place.

52. A stack-on panel assembly as set forth in claim 29, wherein:

said release member comprises a release bracket slidably mounted in said stacker panel for generally vertical reciprocation between said locked and unlocked positions.

53. A stack-on panel assembly as set forth in claim 29, wherein:

said window on said release bracket is defined in part by an end edge configured to abut said free end portion of said second latch member when said release bracket is shifted to said unlocked position to thereby disengage said first latch member from said second latch member.

54. A stack-on panel assembly as set forth in claim 29, wherein:

said connector bracket has a generally L-shaped side elevational configuration with a generally horizontal leg defining said first portion thereof and shaped for connection with the top portion of said base panel, and a generally vertical leg defining said second portion thereof and disposed generally perpendicular to said horizontal leg.

55. A stack-on panel assembly as set forth in claim 54, wherein:

said connector bracket includes at least one vertically oriented fastener aperture through said horizontal leg; and including at least one fastener extending through said fastener aperture and shaped to be anchored in the top portion of the base panel to detachably mount said connector bracket on the base panel.

56. A stack-on panel assembly as set forth in claim 54, wherein:

said vertical leg of said connector bracket includes a blade-shaped upper end configured for close reception in said slot.

57. A stack-on panel assembly as set forth in claim 29, wherein:

said stack-on panel assembly includes a pair of said connector brackets shaped for connection with opposite sides of the base panel; and said stacker panel includes a pair of said vertically extending slots disposed adjacent opposite sides thereof in which said second portions of said connector brackets are closely received.

58. A stack-on panel assembly as set forth in claim 29, wherein:

said stacker panel includes a central transparent panel mounted in a marginal frame.

* * * * *